US005818398A

United States Patent [19]

Tsuru et al.

[11] Patent Number: 5,818,398

[45] Date of Patent: Oct. 6, 1998

[54] SURFACE MOUNTING TYPE ANTENNA SYSTEM

[75] Inventors: Teruhisa Tsuru, Kameoka; Haruhumi Mandai, Takatsuki; Koji Shiroki; Kenji Asakura, both of Shiga, all of Japan

[73] Assignee: Murata Mfg. Co., Ltd., Kyoto, Japan

[21] Appl. No.: 823,828

[22] Filed: Mar. 25, 1997

Related U.S. Application Data

[63] Continuation of Ser. No. 464,394, Jun. 5, 1995, abandoned.

[30] Foreign Application Priority Data

May 17, 1995 [JP] Japan ..... 7-118428
May 17, 1995 [JP] Japan ..... 7-118429

[51] Int. Cl.[6] ..... H01Q 1/24; H01Q 1/36

[52] U.S. Cl. ..... 343/895; 343/702; 343/873

[58] Field of Search ..... 343/895, 872, 343/873, 702; H01Q 1/24, 1/36

[56] References Cited

U.S. PATENT DOCUMENTS

| | | | |
|---|---|---|---|
| 2,472,106 | 6/1949 | Hansen | 343/727 |
| 3,300,749 | 1/1967 | Lombardi | 343/895 |
| 5,136,303 | 8/1992 | Cho et al. | 343/730 |
| 5,250,923 | 10/1993 | Ushiro et al. | 336/83 |
| 5,313,216 | 5/1994 | Wang et al. | 343/895 |
| 5,341,148 | 8/1994 | Walter et al. | 343/895 |
| 5,341,149 | 8/1994 | Valimaa et al. | 343/895 |
| 5,412,392 | 5/1995 | Tsunekawa | 343/895 |
| 5,438,339 | 8/1995 | Itoh et al. | 343/895 |
| 5,450,090 | 9/1995 | Gels et al. | 343/846 |
| 5,479,182 | 12/1995 | Sydor | 343/895 |
| 5,541,610 | 7/1996 | Imanishi et al. | 343/702 |
| 5,589,842 | 12/1996 | Wang et al. | 343/895 |
| 5,592,184 | 1/1997 | Cassel et al. | 343/895 |
| 5,594,461 | 1/1997 | O'Neill, Jr. | 343/895 |

FOREIGN PATENT DOCUMENTS

| | | | |
|---|---|---|---|
| 320404 | 6/1989 | European Pat. Off. . | |
| 520564 | 12/1992 | European Pat. Off. . | |
| 2702091 | 9/1994 | France . | |
| 4436157 | 4/1995 | Germany . | |
| 451213 | 7/1936 | United Kingdom | 343/895 |
| 778518 | 7/1957 | United Kingdom | 343/895 |
| 92 05602 | 4/1992 | WIPO . | |

OTHER PUBLICATIONS

J.P. Casey, et al., "Square Helical Antenna with a Dielectric Core", *IEEE Transactions of Electromagnetic Compatability*, vol. 30, No. 4, Nov. 1988, pp. 429–436.

*Primary Examiner*—Hoanganh T. Le
*Attorney, Agent, or Firm*—Ostrolenk, Faber, Gerb, Soffen, LLP

[57] ABSTRACT

A surface mounting type antenna system 10 is formed by spirally winding a conductor 14 made of copper or copper alloy, with a power supply member 12 provided at one end of the conductor 14, the other end thereof being a free end 13, on the edge faces of a rectangular parallelepiped as a dielectric substrate 11 by printing, deposition, pasting or plating. The dielectric substrate 11 is prepared by stacking a plurality of layers of ceramics, resin or a combination of ceramics and resin. On the underside 111 of the dielectric substrate 11 lies a power supply terminal 15 to which the power supply member 12 of the conductor 14 is connected. The power supply terminal 15 is simultaneously used as a fixing terminal for securing the surface mounting type antenna system 10 to, for example, a mounting board. Moreover, the conductor 14 squarely intersecting the axis C of the conductor winding is rectangular in transverse cross section having a width of w and a length of l.

55 Claims, 9 Drawing Sheets

SURFACE MOUNTING TYPE ANTENNA SYSTEM

This is a Continuation of application Ser. No. 08/464,394 filed on Jun. 5, 1995, now abandoned.

BACKGROUND OF THE INVENTION

1. Field of the Invention

The present invention relates to surface mounting type antenna systems, and more particularly to a surface mounting type antenna system for use in mobile radio communications and local area networks (LAN).

2. Description of the Related Art

FIG. 1 is a sectional view of a conventional surface mounting type antenna system 90, wherein reference numeral 91 denotes an insulating material layer; 92, a flat-plate laminated coil; 93, a magnetic material layer; and 94*a*, 94*b*, external connection terminals.

The antenna system 90 employs amorphous magnetic metal (relative permeability=$10^4$ to $10^5$) for the magnetic material layer 93 to lower the resonance frequency by increasing the inductance of the antenna system 90.

However, the line length in the conventional surface mounting type antenna system 90 is about (wavelength of resonant frequency)/10, which is less than (wavelength of resonant frequency)/4 in a dipole antenna. Therefore, the electrical volume and the gain have been small and poor. Moreover, the loss of the magnetic material layer tends to become greater at frequencies of over 100 MHz, thus making the magnetic material layer unusable at that frequency range.

Also, it is important that antennae for use in mobile radio communications and local area networks should be small-sized, and a normal-mode helical antenna represents one of those which satisfy such a demand. FIGS. 2, 3 and 4 illustrate the structure of such a normal surface mounting type antenna system.

FIG. 2 shows a normal-mode helical antenna 100*a* including a linear conductor 101 which is wound spirally so that its spiral cross section 102 perpendicular to the axis C of winding is substantially circular, and a power supply member 103 which is situated at one end of the conductor 101, the other end being a free end 104.

FIG. 3 shows a normal-mode helical antenna 100*b* including a linear conductor 101 wound spirally so that its spiral cross section 102 perpendicular to the axis C of winding is substantially circular, and a power supply member 103 situated substantially at the halfway point of the conductor 101, both ends of the conductor 101 being each free ends 104.

Further, FIG. 4 shows a normal-mode helical antenna 100*c* comprising a linear conductor 101 wound spirally so that its spiral cross section 102 perpendicular to the axis C of winding is substantially rectangular, and a power supply member 103 situated substantially at the halfway point of the conductor 101, both ends of the conductor 101 being each free ends 104.

However, each of the normal-mode helical antennae 100*a* to 100*c* provides no sensitivity to dominant and cross polarized waves from the direction of the axis C of the conductor winding 101 but sensitivity thereto from the direction perpendicular to the axis C of the conductor winding 101 (the VV direction in FIGS. 2 to 4).

Therefore, transmission and reception are impossible in a case where the transmission of dominant and cross polarized waves are made in such a state that the normal-mode helical antennae 100*a* to 100*c* tilt at 90°; the problem is that the sensitivity is dependent on their postures.

SUMMARY OF THE INVENTION

The present invention has been made to solve the foregoing problems, and an object of the invention is to provide a surface mounting type antenna system which provides a high gain and is free from dependence on its posture.

Another object of the invention is to provide a compact surface mounting type antenna system for yielding not only sensitivity to dominant and cross polarized waves in at least both directions: the direction of and a direction perpendicular to, the axis of conductor winding but also that is free from dependence on its posture.

In order to solve the aforementioned problems, a first aspect of the invention has been achieved by the provision of a surface mounting type antenna system which comprises a dielectric substrate, and a conductor which is wound spirally on the surface or in the dielectric substrate. Further, at least a power supply terminal for use in applying voltage to the conductor is provided on the surface of the dielectric substrate.

A fixing terminal for securing the dielectric substrate onto the surface of a mounting board is also provided onto the surface of the dielectric substrate.

The spiral conductor squarely intersecting the axis of the conductor winding partly includes at least a linear portion in transverse cross section.

Further, in order to solve the above-mentioned problems, a second aspect of the invention has been achieved by the provision of an antenna which comprises a conductor which is wound spirally, and a power supply member provided at one end of the conductor, the other end thereof being a free end, wherein the sensitivity of the antenna to dominant and cross polarized waves is provided in at least both directions: the direction of and a direction perpendicular to, the axis of conductor winding.

Moreover, the spiral conductor squarely intersecting the axis of the conductor winding partly includes at least a linear portion in transverse cross section.

Further, the conductor is provided on the surface of or in a dielectric substrate.

According to the surface mounting type antenna system of the invention, the propagation velocity becomes slow, whereas wavelength contraction occurs as the antenna systems incorporates the dielectric substrate, whereby an effective line length is rendered $\in$½ times greater, where $\in$=dielectric constant of the dielectric substrate.

Also, according to the surface mounting type antenna system of the invention, the provision of the fixing terminal allows the dielectric substrate to be secured onto the surface mounting board with stability.

Further, according to the surface mounting type antenna system of the invention, since the conductor squarely intersecting the axis of the winding is substantially rectangular in transverse cross section including the linear portion in part, the line length of the antenna can be made greater than that of an antenna whose spiral conductor is substantially circular or elliptical in transverse cross section on the assumption that their transverse cross-sectional areas are equal.

According to the helical antenna of the invention, it is feasible to obtain sensitivity substantially equal to that of a dipole antenna, that is, sensitivity to dominant and cross polarized waves and sensitivity at a level at which transmission and reception are possible.

The above and other objects and features of the present invention will be more apparent from the following description taken in conjunction with the accompanying drawings.

BRIEF DESCRIPTION OF THE DRAWINGS

FIGS. 21A and 21B are diagrams illustrating spiral conductors of surface mounting type antenna systems according to the present invention, in which FIG. 21A is a spiral conductor having a substantially track-like transverse cross section; and FIG. 21B is a spiral conductor having a substantially semicylindrical transverse cross section;

DETAILED DESCRIPTION OF THE PREFERRED EMBODIMENTS

Figure 1:
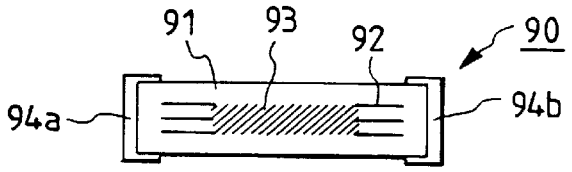
FIG. 1 PRIOR ART
FIG. 1 is a perspective view showing a conventional surface mounting type antenna system.
Figure 2:
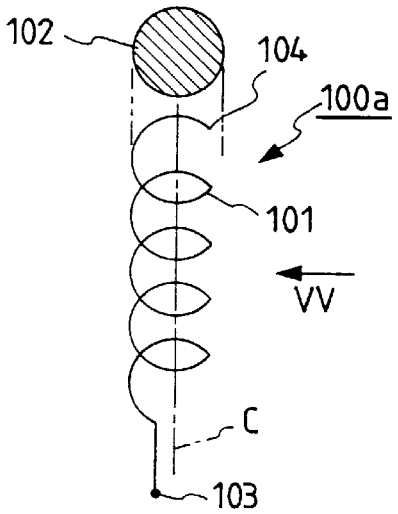
FIG. 2 PRIOR ART
FIG. 2 is a perspective view showing a conventional helical antenna.
Figure 3:
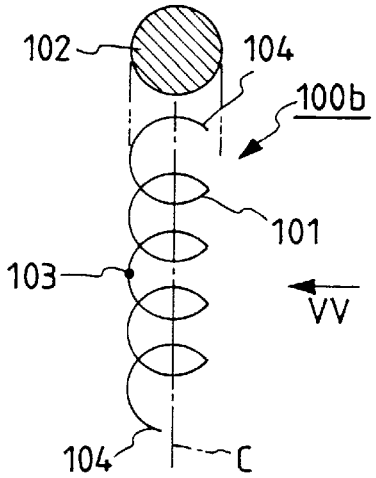
FIG. 3 PRIOR ART
FIG. 3 is a perspective view showing another conventional helical antenna.
Figure 4:
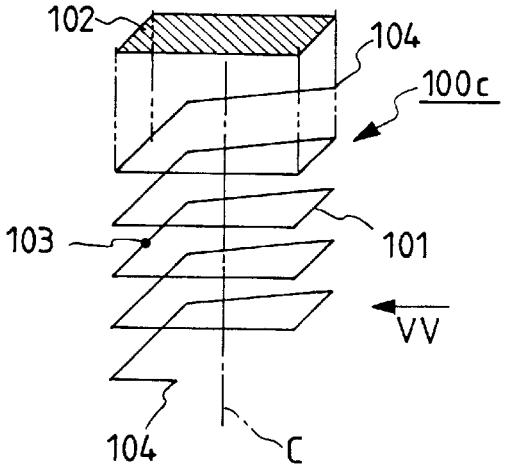
FIG. 4 PRIOR ART
FIG. 4 is a perspective view of still another conventional helical antenna.

Referring to the drawings, a description will subsequently be given of embodiments of the present invention, wherein like reference characters designate like or corresponding component parts in a first embodiment of the invention and the description thereof will be omitted.

Figure 5:
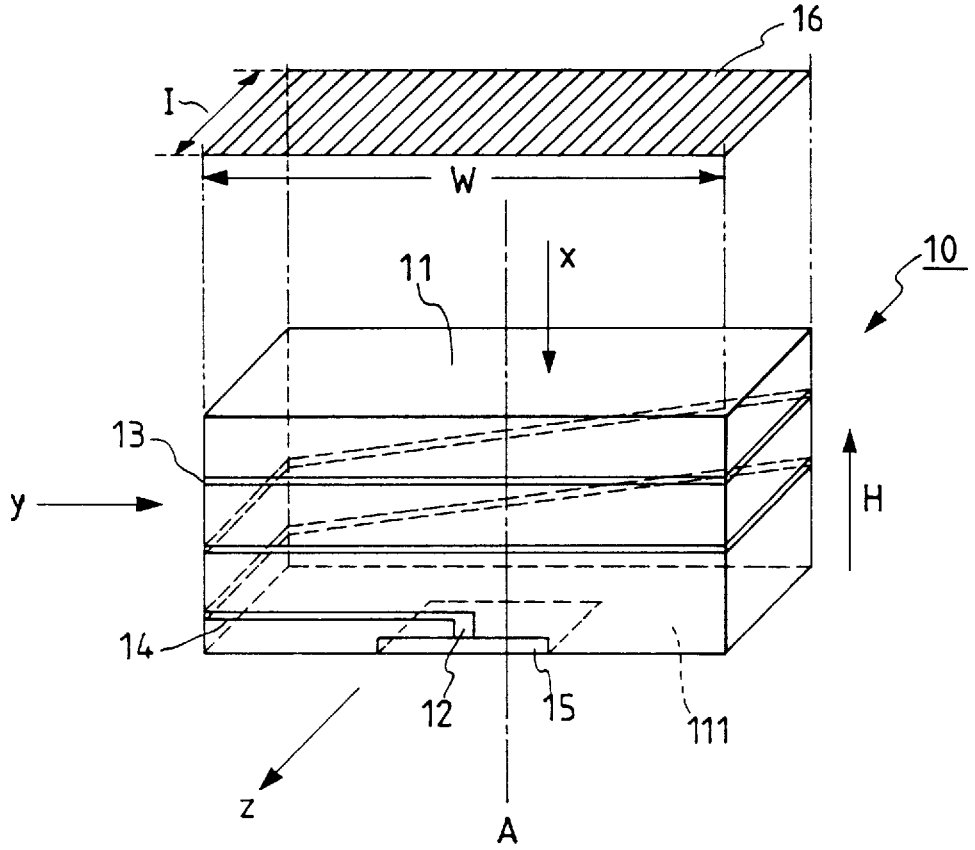
FIG. 5 is a perspective view showing a surface mounting type antenna system according to a first embodiment of the present invention.

FIG. 5 is a perspective view showing a first surface mounting type antenna system embodying the present invention. A surface mounting type antenna system 10 is formed by spirally winding a conductor 14 made of copper or copper alloy, with a power supply member 12 provided at one end of the conductor 14, the other end thereof being a free end 13, on the edge faces of a rectangular parallelepiped as a dielectric substrate 11 by printing, deposition, pasting or plating. The dielectric substrate 11 is prepared by stacking a plurality of layers of mixed material mainly containing barium oxide, aluminum oxide and silica, or resin, for example, teflon resin, or a combination of ceramics and resin. In this case, the conductor 14 is wound in the direction of height of the dielectric substrate 11 (in the direction of arrow H in FIG. 5).

On the underside 111 of the dielectric substrate 11 lies a power supply terminal 15 to which the power supply member 12 of the conductor 14 is connected. The power supply terminal 15 is simultaneously used as a fixing terminal for securing the surface mounting type antenna system 10 to a mounting part (not shown) provided with an external circuit. In this practice of the invention, the dielectric substrate 11 may be formed by stacking a plurality of dielectric substrate layers or otherwise formed with, for example, one sheet of dielectric substrate layer. At this time, the conductor 13 squarely intersecting the axis A of the conductor winding 13 is rectangular in transverse cross section 14 having a width of w and a length of l.

Now the line length of the surface mounting type antenna system 10 in this practice of the invention is compared with that of a conventional normal-mode helical antenna (radius: a) whose spiral conductor is circular in transverse cross section.

Assuming that the transverse cross-sectional area S perpendicular to the axis of the winding and the number of turns N are constant, the transverse cross-sectional areas S which are rectangular and circular are each expressed by in the rectangular case: $S=w\times l$; and in the circular case: $S=\pi a^2$.

Since the line length is the outer periphery of the spiral cross section×N, the rectangular and circular line lengths l1, l2 are each given by in the rectangular case: $l_1=2\times(w+l)\times N$; and in the circular case: $l_2=2\times(\pi\times w\times l)^{1/2}\times N$.

Consequently, the line length $l_1$ of the surface mounting type antenna system 10 rectangular in transverse cross section in this practice of the invention is proved longer.

Further, measurement was made of the sensitivity of the surface mounting type antenna system 10 in the directions of x-, y- and z- axes.

FIGS. 15 through 20 show the sensitivity of the surface mounting type antenna system 10, wherein there is shown sensitivity to dominant and cross polarized waves in the directions of x-axes, sensitivity to dominant and cross polarized waves in the directions of y-axes, and sensitivity to dominant and cross polarized waves in the directions of z-axes, respectively.

It was also proved from the measured results of sensitivity that the surface mounting type antenna system 10 functioned almost non-directionally as it had shown sensitivity to the dominant and cross polarized waves in not only the direction perpendicular to the axis A of the winding, that is, in the directions of y- and z-axes but also the direction of the axis A of the winding, that is, in the direction of x-axis.

Although a description has been given of the case where the conductor 14 is formed by printing, deposition, pasting or plating in the practice of the invention above, a spiral groove may be made in the dielectric substrate 11 so as to wind a plated or enameled wire along the groove.

Since the conductor 14 squarely intersecting the axis A of the winding is rectangular in transverse cross section 16 in the first embodiment of the invention as set forth above, the line length can be made greater than that of the circular or elliptical conductor. Therefore, an area of current distribution is increased further and the quantity of electric waves thus radiated is also increased further, so that the antenna gain is made improvable thereby further.

The surface mounting type antenna system 10 functions almost non-directionally and thus has sensitivity to dominant and cross polarized waves in the three directions of x-, y- and z-axes, so that transmission and reception become possible, irrespective of the position of the mobile communications apparatus. As a result, the sensitivity of the surface mounting type antenna system 10 independent of its posture.

Moreover, a propagation velocity becomes slow, whereas wavelength contraction occurs, whereby an effective line length is rendered $\in^{1/2}$ times greater, where $\in$=dielectric constant of the dielectric substrate. The effective line length becomes greater than that of the conventional surface mounting type antenna system. Therefore, an area of current distribution is increased and the quantity of electric waves thus radiated is also increased, so that the antenna gain is made improvable thereby.

If characteristics similar to those of the conventional surface mounting type antenna system are conversely desired, moreover, the line length will be reduced to $1/\in^{1/2}$. It is therefore possible to reduce the size of the surface mounting type antenna system 10.

Since the conductor 14 is wound in the direction of height of the dielectric substrate 11, further, the number of turns can be decreased by increasing the transverse cross-sectional area S squarely crossing the axis A of the winding. Consequently, the height of the surface mounting type antenna system 10 is reducible.

Figure 6:
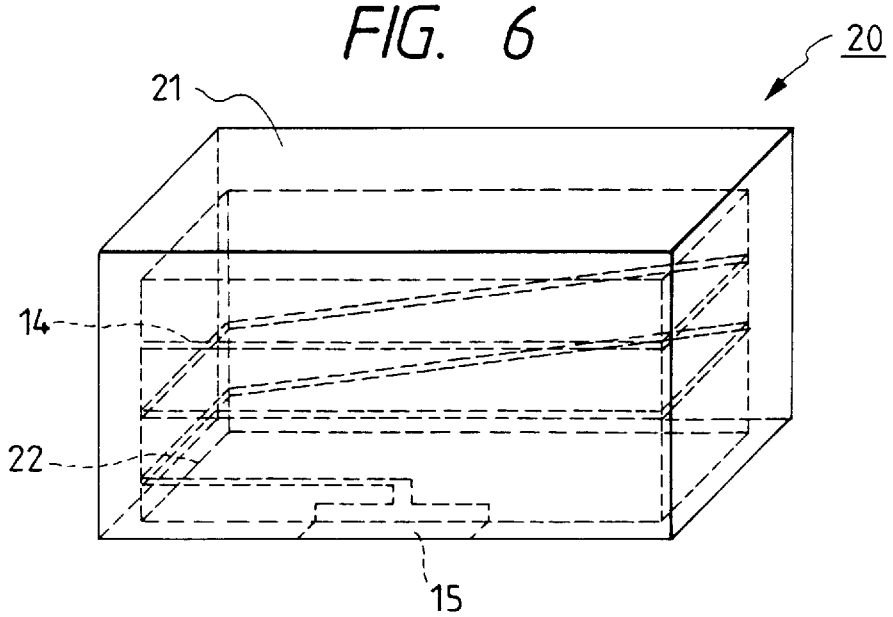
FIG. 6 is a perspective view showing a surface mounting type antenna system according to a second embodiment of the present invention.

FIG. 6 is a perspective view of a second surface mounting type antenna system embodying the present invention. A surface mounting type antenna system 20 is formed by spirally winding the conductor 14 by printing, deposition, pasting or plating, along the inner walls of a cavity 22 provided in a dielectric substrate 21 made of ceramics, resin or a combination of ceramics and resin. As in the first embodiment of the invention, the conductor 14 is wound in the direction of height of the dielectric substrate 21 at this time.

As set forth above, the conductor 14 is not exposed on the edge faces of the dielectric substrate 21 in the second embodiment of the invention, which makes this surface mounting type antenna system easy to handle in addition to making achievable the same effect as that of the first surface mounting type antenna system 10 according to the present invention likewise.

Figure 7:
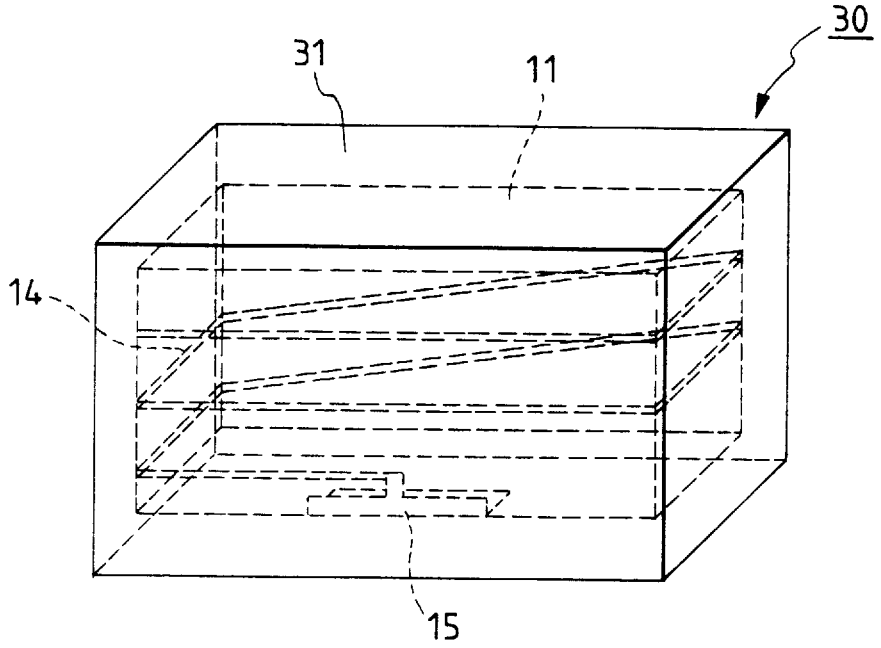
FIG. 7 is a perspective view showing a surface mounting type antenna system according to a third embodiment of the present invention.

FIG. 7 is a perspective view of a third surface mounting type antenna system embodying the present invention. As in the first embodiment of the invention, a surface mounting type antenna system 30 is formed by spirally winding the conductor 14 on the edge faces of the dielectric substrate 11 and sealing up the conductor 14 in a dielectric substrate 31 made of ceramics, resin or a combination of ceramics and rein. As in the first embodiment of the invention, the conductor 14 is wound in the direction of height of the dielectric substrate 21.

As set forth above, the conductor 14 is sealed up in the dielectric substrate 31 in the third embodiment of the invention, whereby in comparison with the second embodiment of the invention, the wavelength is decreased further and the effective line length of the surface mounting type antenna system 30 is also increased further. Therefore, an area of current distribution is increased further and the quantity of electric waves thus radiated is also increased further, so that the antenna gain is made improvable thereby further.

Figure 8:
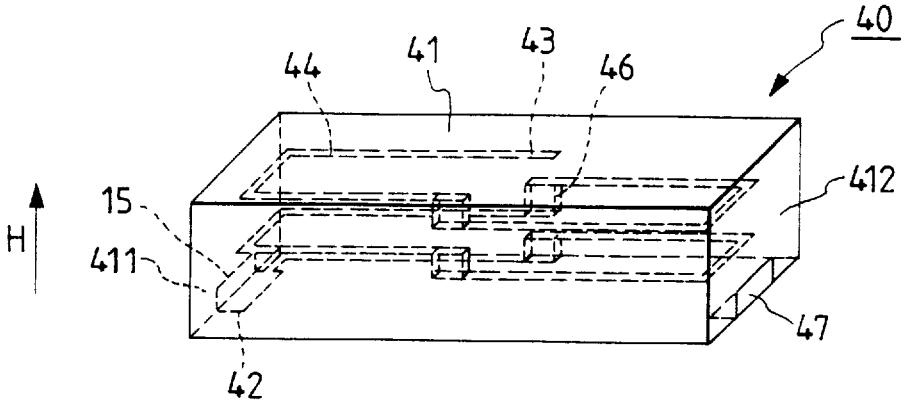
FIG. 8 is a perspective view showing a surface mounting type antenna system according to a fourth embodiment of the present invention.
Figure 9:
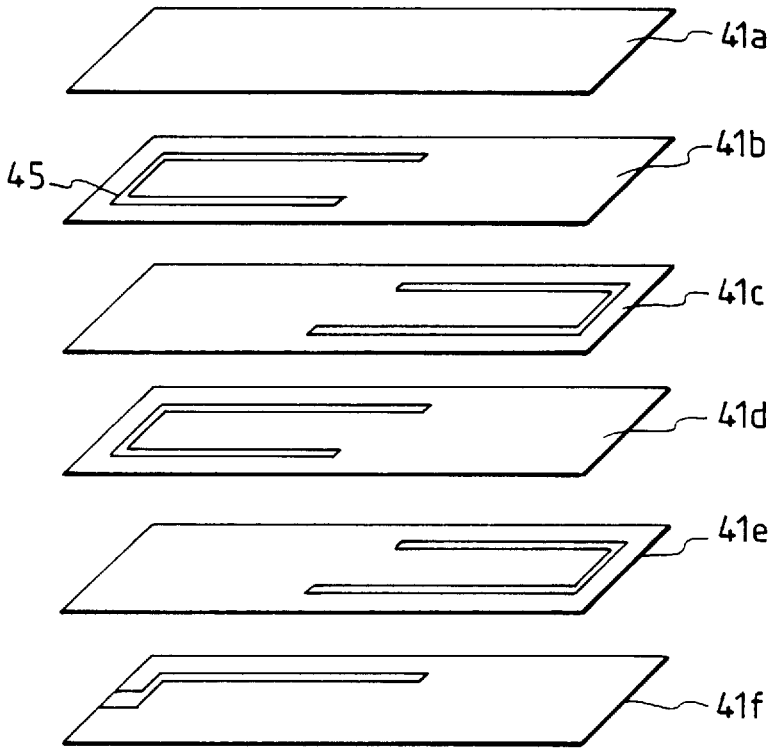
FIG. 9 is an exploded perspective view showing the surface mounting type antenna system of FIG. 8.

FIGS. 8 and 9 are perspective views of a fourth surface mounting type antenna system embodying the present invention. A surface mounting type antenna system 40 is formed by spirally winding a conductor 44 made of copper or copper alloy, with a power supply member 42 provided at one end of the conductor 44, the other end thereof being a free end 43, in a rectangular parallelepiped as a dielectric substrate 41. The dielectric substrate 41 is prepared by stacking a plurality of layers of ceramics, resin or a combination of ceramics and resin. In this case, the conductor 44 is wound in the direction of height of the dielectric substrate 41 (in the direction of arrow H in FIG. 5) as in the first embodiment of the invention.

The conductor 42 is formed into a spiral through the steps of providing conductor patterns 45 each on the surfaces of dielectric substrate layers 41*b* to 41*f* constituting the dielectric substrate 41 by printing, vapor deposition, pasting or plating, stacking the dielectric substrate layers 41*a* to 41*f*, and coupling the conductor patterns 45 with pierced holes 46.

As set forth above, the laminated structure employed for the fourth surface mounting type antenna system 40 according to the present invention makes formable a compact inexpensive surface mounting type antenna system in addition to making obtainable the same effect as that of the third surface mounting type antenna system 30.

Figure 10:
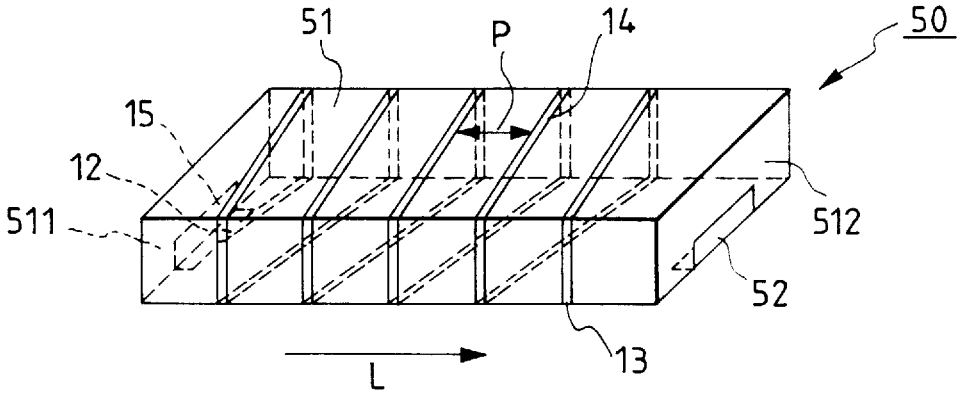
FIG. 10 is a perspective view showing a surface mounting type antenna system according to a fifth embodiment of the present invention.

FIG. 10 is a perspective view of a fifth surface mounting type antenna system embodying the present invention. A surface mounting type antenna system 50 is formed by spirally winding the conductor 14 on the edge faces of a rectangular parallelepiped as a dielectric substrate 51 by printing, deposition, pasting or plating. The dielectric substrate 51 is prepared by stacking a plurality of layers of ceramics, resin or a combination of ceramics and resin. In this case, the conductor 14 is wound in the longitudinal direction of the dielectric substrate 51 (in the direction of an arrow L in FIG. 10).

The power supply terminal 15 is formed on one edge face 511 of the dielectric substrate 51 and the power supply member 12 of the conductor 14 is connected to the edge face 511. A fixing terminal 52 for securing the surface mounting type antenna system 50 to a mounting board (not shown) provided with an external circuit is formed on the opposite edge face 512.

Although a description has been given of the case where the conductor 14 is formed by printing, deposition, pasting or plating in the practice of the invention above, a spiral groove may be made in the dielectric substrate 51 so as to wind a plated or enameled wire directly along the groove of the dielectric substrate 51 as in the first embodiment of the invention.

Since the conductor 14 is wound in the longitudinal direction of the dielectric substrate 51 in the fifth embodiment of the invention as set forth above, the winding pitch P can be set greater. Therefore, the inductance of the surface mounting type antenna system 50 can also be lowered, so that the surface mounting type antenna system 50 can operate at a frequency of 1 GHz or higher.

Moreover, the provision of the fixing terminal 52 makes it possible to mount the antenna system with stability when it is surface-mounted.

Figure 11:
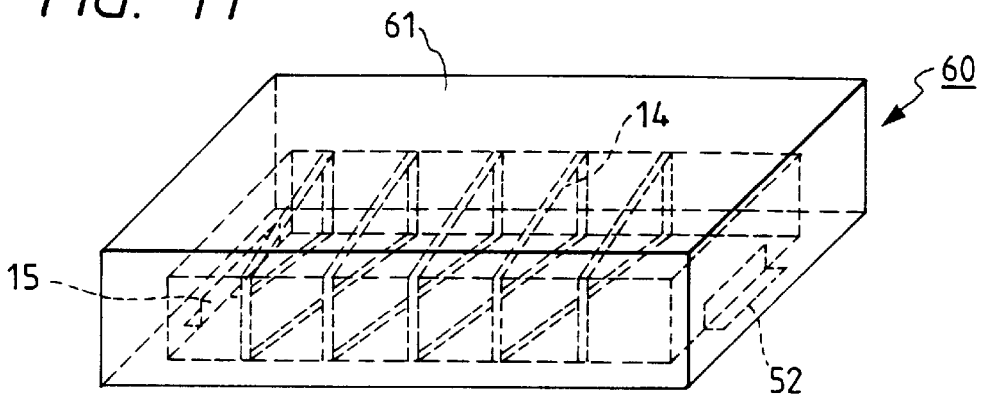
FIG. 11 is a perspective view showing a surface mounting type antenna system according to a sixth embodiment of the present invention.

FIG. 11 is a perspective view of a sixth surface mounting type antenna system embodying the present invention. A surface mounting type antenna system 60 is formed by spirally winding the conductor 14 by printing, deposition, pasting or plating, along the inner walls of a cavity 62 provided in a dielectric substrate 61 made of ceramics, resin or a combination of ceramics and resin. As in the fifth embodiment of the invention, the conductor 14 is wound in the longitudinal direction of the dielectric substrate 61 at this time.

As set forth above, the conductor 14 is not exposed on the edge faces of the dielectric substrate 61 in the sixth embodiment of the invention, which makes this surface mounting type antenna system 50 easy to handle in addition to making achievable the same effect as that of the fifth surface mounting type antenna system according to the present invention likewise.

Figure 12:
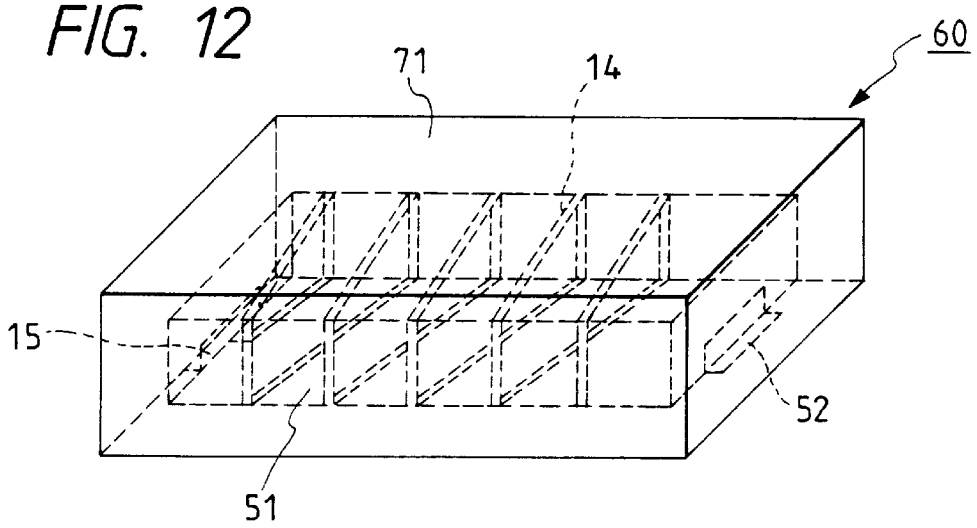
FIG. 12 is a perspective view showing a surface mounting type antenna system according to a seventh embodiment of the present invention.

FIG. 12 is a perspective view of a seventh surface mounting type antenna system embodying the present invention. As in the fifth embodiment of the invention, a surface mounting type antenna system 70 is formed by spirally winding the conductor 14 on the edge faces of the dielectric substrate 51 and sealing up the conductor 14 in a dielectric substrate 71 made of ceramics, resin or a combination of ceramics and resin. As in the fifth embodiment of the invention, the conductor 14 is wound in the longitudinal direction of the dielectric substrate 71.

As set forth above, the conductor 14 is sealed up in the dielectric substrate 71 in the seventh embodiment of the invention, whereby in comparison with the fifth embodiment of the invention, the wavelength is decreased further and the effective line length of the surface mounting type antenna system 70 is also increased further. Therefore, an area of current distribution is increased further and the quantity of electric waves thus radiated is also increased further, so that the antenna gain is made improvable thereby further.

Figure 13:
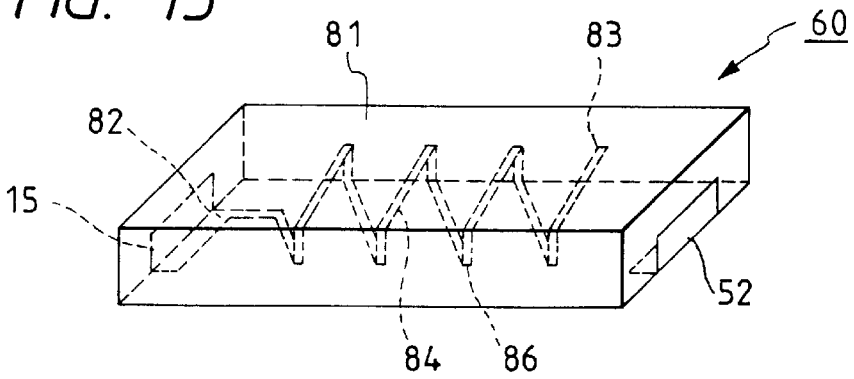
FIG. 13 is a perspective view showing a surface mounting type antenna system according to an eighth embodiment of the present invention.
Figure 14:
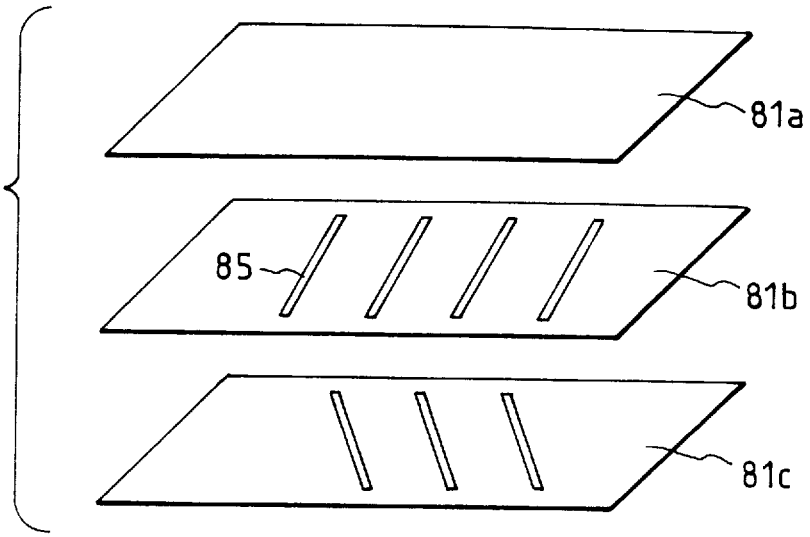
FIG. 14 is an exploded perspective view showing the surface mounting type antenna system of FIG. 13.
Figure 15:
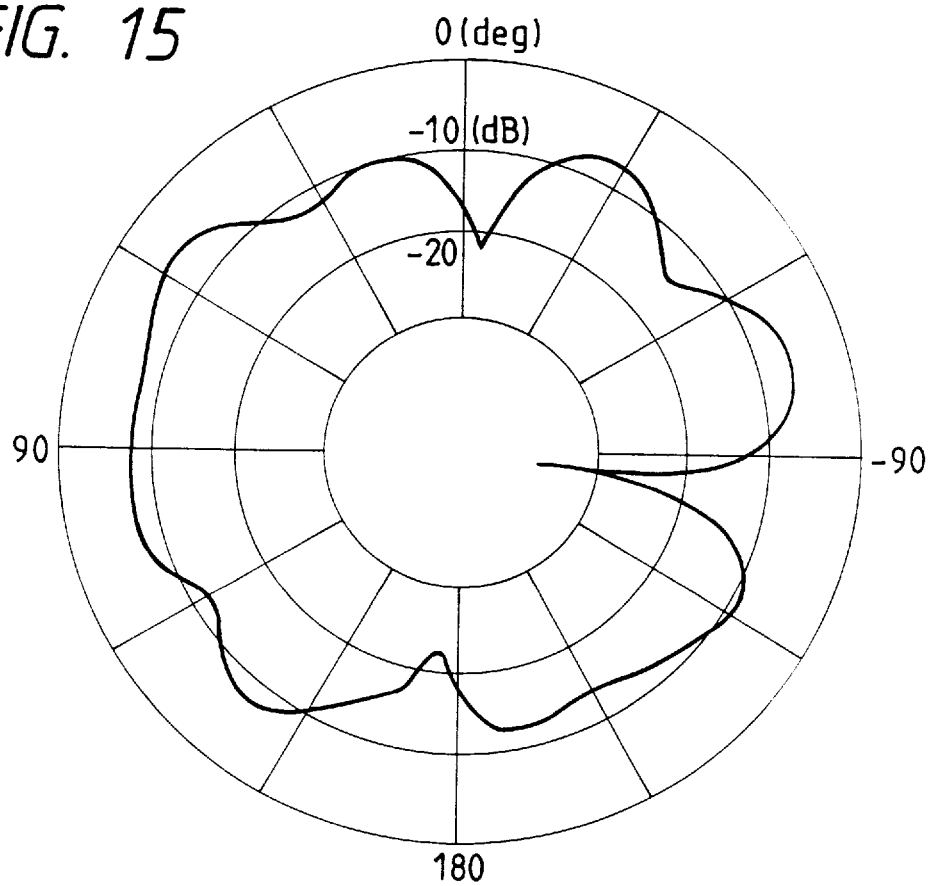
FIG. 15 is a chart illustrating the sensitivity of the surface mounting type antenna system of FIG. 5 to a dominant polarized wave in the direction of x-axis.
Figure 16:
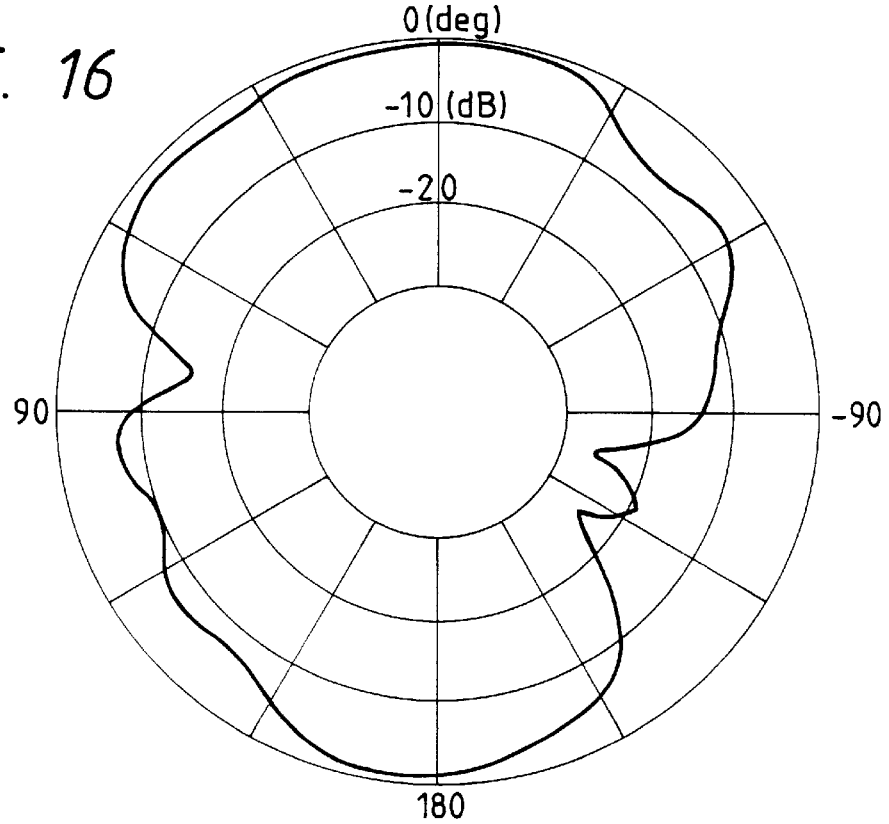
FIG. 16 is a chart illustrating the sensitivity of the surface mounting type antenna system of FIG. 5 to a cross polarized wave in the direction of x-axis.
Figure 17:
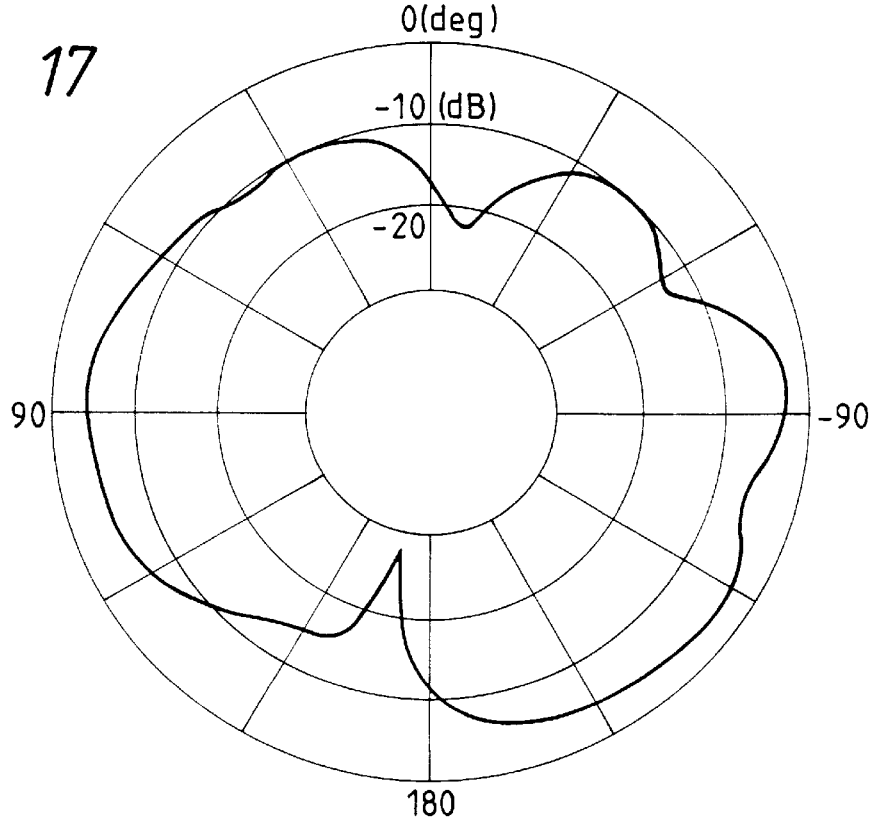
FIG. 17 is a chart illustrating the sensitivity of the surface mounting type antenna system of FIG. 5 to the dominant polarized wave in the direction of y-axis.
Figure 18:
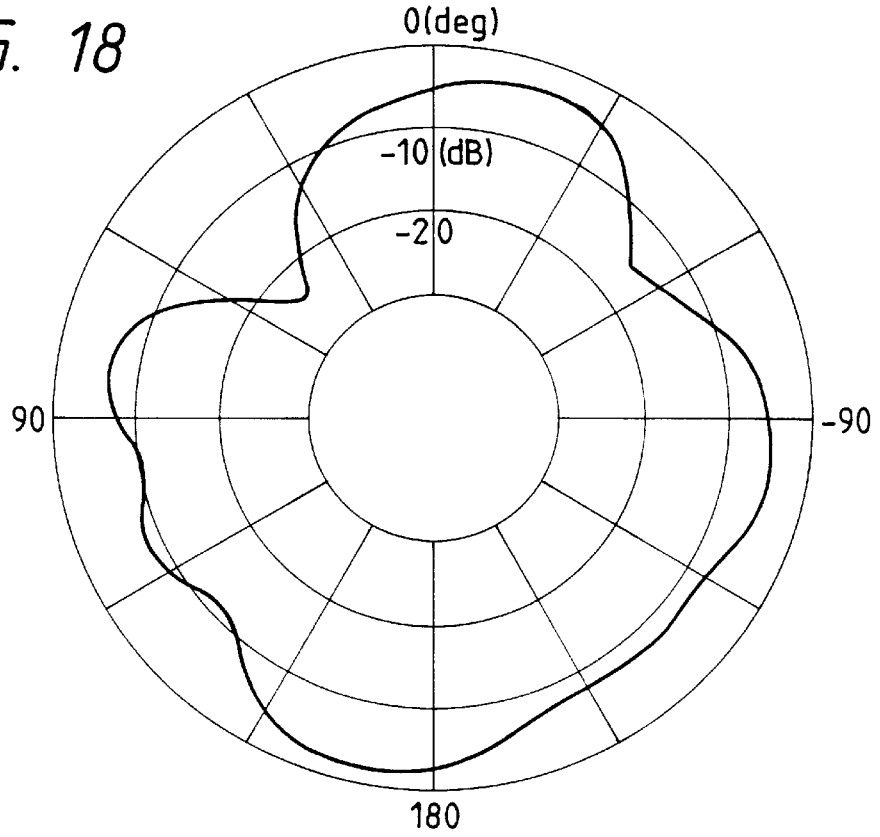
FIG. 18 is a chart illustrating the sensitivity of the surface mounting type antenna system of FIG. 5 to the cross polarized wave in the direction of y-axis.
Figure 19:
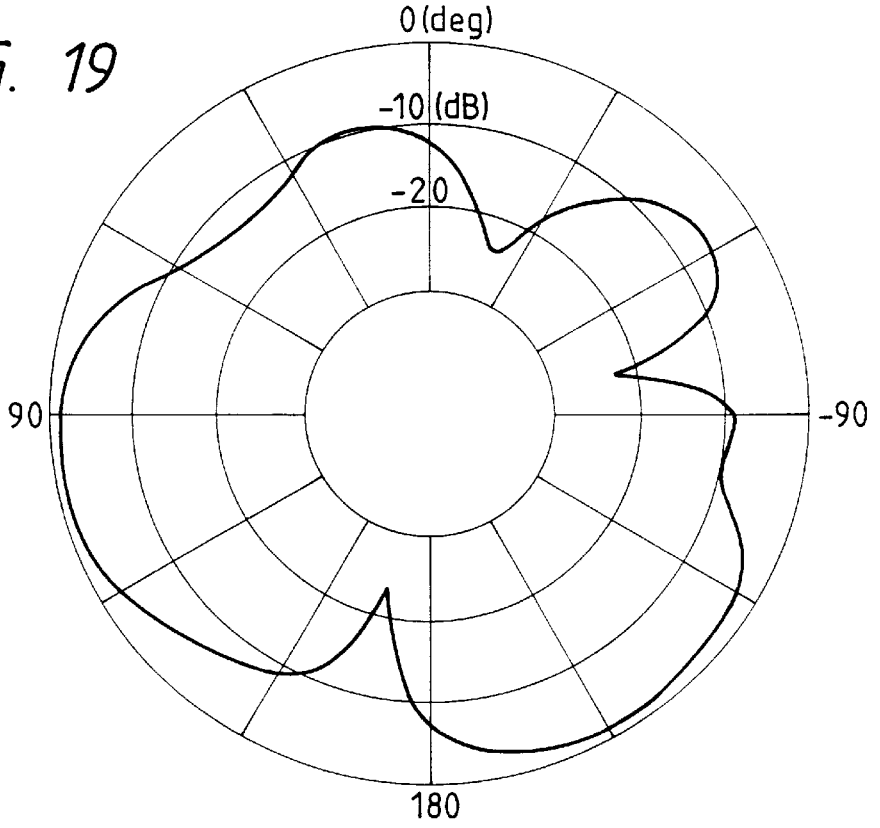
FIG. 19 is a chart illustrating the sensitivity of the surface mounting type antenna system of FIG. 5 to the dominant polarized wave in the direction of z-axis.
Figure 20:
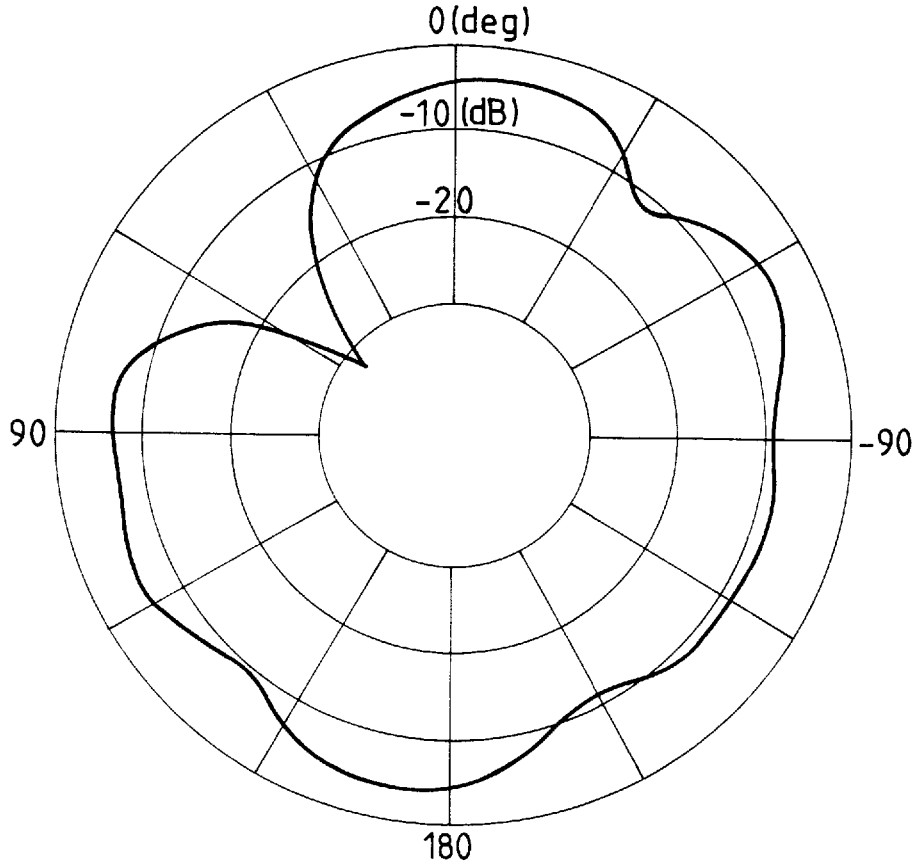
FIG. 20 is a chart illustrating the sensitivity of the surface mounting type antenna system of FIG. 5 to the cross polarized wave in the direction of z-axis.

FIGS. 13 and 14 are perspective views of an eighth surface mounting type antenna system embodying the present invention. A surface mounting type antenna system 80 is formed by spirally winding a conductor 84 made of copper or copper alloy, with a power supply member 82 provided at one end of the conductor 84, the other end thereof being a free end 83, in a rectangular parallelepiped as a dielectric substrate 81. The dielectric substrate 81 is prepared by stacking a plurality of layers of ceramics, resin or a combination of ceramics and resin. In this case, the conductor 84 is wound in the longitudinal direction of the dielectric substrate 81 as in the fifth embodiment of the invention.

The conductor 84 is formed into a spiral through the steps of providing conductor patterns 85 each on the surfaces of dielectric substrate layers 81*b* and 81*c* constituting a dielectric substrate 81 by printing, deposition, pasting or plating, stacking the dielectric substrate layers 81*a* to 81*c*, and coupling the conductor patterns 85 with pierced holes 86.

As set forth above, the laminated structure employed for the eighth surface mounting type antenna system 80 according to the present invention makes formable a compact inexpensive surface mounting type antenna system in addition to making obtainable the same effect as that of the seventh surface mounting type antenna system 70.

Figure 21A:
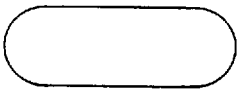
Figure 21B:
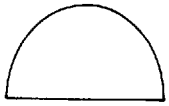

Although a description has been given of the case where the spiral conductor is rectangular in transverse cross section, it may be in the shape of substantially a track having two straight lines and two curved lines, or a semicylinder having one straight line and one curved line as shown in FIGS. 21A and 21B; that is, it may be in any shape having at least one straight line.

With respect to the spiral configurations, the combination of rectangles substantially similar in transverse cross section have been used to constitute the conductor. However, a combination of those which include at least a linear portion in part and are different in transverse cross section may also be employed.

For example, the conductor may be made spiral in such a manner that its traverse cross sectional size is gradually increased or decreased toward the free end from the power supply member.

Although copper or copper alloy has been used to form the conductor, it may also be gold, silver, platinum, vanadium or the like as long as it is a low-resistant conductor.

Although a description has been given of the case where the dielectric substrate is a rectangular parallelepiped, it may also be a solid sphere, a regular hexahedron, a circular cylinder, a circular cone or a pyramid.

According to the surface mounting type antenna system of the present invention, the surface mounting type antenna system functions almost non-directionally and thus has sensitivity to dominant and cross polarized waves in the three directions of x-, y- and z-axes, so that transmission and reception become possible, irrespective of the position of the mobile communications apparatus. As a result, the sensitivity of the surface mounting type antenna system is independent of dependence on its posture.

Since a dielectric substrate is used, propagation velocity becomes slow, whereas wavelength contraction occurs, whereby an effective line length is rendered $\in^{1/2}$ times greater, where $\in$=dielectric constant of the dielectric substrate. The effective line length becomes greater than that of the conventional surface mounting type antenna system. Therefore, an area of current distribution is increased and the quantity of electric waves thus radiated is also increased, so that the antenna gain is made improvable thereby.

If characteristics similar to those of the conventional surface mounting type antenna system are conversely desired, moreover, the line length will be reduced to $1/\in^{1/2}$. It is therefore possible to reduce the size of the surface mounting type antenna system.

According to the surface mounting type antenna system of the present invention, the provision of the fixing terminal makes it possible to mount the antenna system with stability when it is surface-mounted.

According to the surface mounting type antenna system of the present invention, since the spiral conductor squarely intersecting the axis of the winding is substantially rectangular in transverse cross section including the linear portion in part, the line length of the antenna can be made greater than that of an antenna whose spiral conductor is substantially circular or elliptical in transverse cross section on the assumption that their transverse cross-sectional areas are equal. Therefore, an area of current distribution is increased further and the quantity of electric waves thus radiated is also increased further, so that the antenna gain is made improvable thereby further.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A surface mounting antenna system comprising:

a dielectric substrate having a surface and having at least a portion of the surface comprising a flat surface to be mounted on a mounting board;

a conductor disposed spirally on the surface of the dielectric substrate; and a power supply terminal provided on a portion of the surface of said dielectric substrate for applying voltage to the conductor, the conductor having one end coupled to the power supply terminal and a second end left unconnected;

said dielectric substrate comprising a plurality of layers stacked on top of each other, the stacked layers establishing a direction normal to the stacked layers, the conductor disposed spirally on the surface of the dielectric substrate having a spiral axis extending perpendicular to the direction normal to the stacked layers.

2. A surface mounting antenna system as claimed in claim 1, further comprising:

a mounting board; and a fixing terminal provided on a portion of the surface of said dielectric substrate for securing said dielectric substrate onto the surface of said mounting board.

3. A surface mounting antenna system as claimed in claim 2, wherein said conductor includes a portion disposed substantially perpendicularly with respect to a longitudinal axis of said dielectric substrate and said portion partly includes at least one linear portion in transverse cross section through the conductor perpendicular to the longitudinal axis.

4. A surface mounting antenna system as claimed in claim 1, wherein said conductor includes a portion disposed substantially perpendicularly with respect to a longitudinal axis of said dielectric substrate and said portion partly includes at least one linear portion in transverse cross section through the conductor perpendicular to the longitudinal axis.

5. A surface mounting antenna system as claimed in claim 1, wherein the conductor is disposed on the surface of the dielectric substrate in a groove disposed on the surface.

6. A helical antenna as claimed in claim 1, wherein said dielectric substrate has an internal surface extending in each of three dimensions and said conductor is disposed on said internal surface.

7. A surface mounting antenna system as claimed in claim 1, wherein said dielectric substrate is contained within a further outer dielectric material enclosing said dielectric substrate.

8. A surface mounting antenna system as claimed in claim 1, wherein said dielectric substrate comprises a plurality of layers of dielectric material.

9. A surface mounting antenna system as claimed in claim 8, wherein portions of the conductor are disposed on separate surfaces of respective ones of said layers of dielectric material joined together to form said dielectric substrate, with conductive through holes through the layers being provided connecting the portions of the conductor on said separate surfaces of different ones of said layers together to form said spirally disposed conductor.

10. A surface mounting antenna system as claimed in claim 1, wherein the dielectric substrate comprises a rectangular parallelopiped with said surface comprising six parallelopiped surfaces, the conductor being disposed on at least four surfaces of said rectangular parallelopiped.

11. A surface mounting antenna system as claimed in claim 1 wherein the conductor is formed by one of printing, deposition, pasting and plating.

12. A surface mounting antenna system as claimed in claim 1, wherein each turn of the conductor has a rectangular shape in transverse cross-section.

13. A surface mounting antenna system as claimed in claim 1 wherein each turn of the conductor has a track-shape in transverse cross-section.

14. A surface mounting antenna system as claimed in claim 1 wherein each turn of the conductor has a semicircular shape in transverse cross-section.

15. A surface mounting antenna system as claimed in claim 1, wherein different turns of the conductor have different shapes in transverse cross-section.

16. A helical antenna comprising:

a dielectric substrate having at least one flat surface to be mounted on a mounting board;

a conductor disposed spirally about and extending along a longitudinal axis of said dielectric substrate; and a power supply member provided at one end of said conductor, the other end of said conductor being a free end;

wherein the sensitivity of the antenna to dominant and cross polarized waves is provided in at least two dimensions, said two dimensions comprising a direction of the longitudinal axis and a direction perpendicular to the longitudinal axis;

said dielectric substrate comprising a plurality of layers stacked on top of each other and establishing a direction normal to the stacked layers;

the conductor disposed spirally about and extending along the longitudinal axis of the dielectric substrate such that the longitudinal axis is perpendicular to the direction normal to the stacked layers.

17. A helical antenna as claimed in claim 16, wherein said conductor includes a portion disposed substantially perpendicularly with respect to the longitudinal axis and said portion partly includes at least a linear portion in transverse cross section through the conductor perpendicular to the longitudinal axis.

18. A helical antenna as in claim 17, wherein said conductor is provided on the surface of the dielectric substrate.

19. A helical antenna as claimed in claim 17, wherein said conductor is provided in a dielectric substrate.

20. A helical antenna as in claim 16, wherein said conductor is provided on the surface of the dielectric substrate.

21. A helical antenna as claimed in claim 20, wherein the conductor is disposed on the surface of the dielectric substrate in a groove disposed on the surface.

22. A helical antenna as claimed in claim 20, wherein said dielectric substrate has an internal surface extending in each of three dimensions and said conductor is disposed on said internal surface.

23. A helical antenna as claimed in claim 20, wherein said dielectric substrate is contained within a further outer dielectric material enclosing said dielectric substrate.

24. A helical antenna as claimed in claim 20, wherein said dielectric substrate comprises a plurality of layers of dielectric material.

25. A helical antenna as claimed in claim 24, wherein portions of the conductor are disposed on separate surfaces of respective ones of said layers of dielectric material joined together to form said dielectric substrate, with conductive through holes through the layers being provided connecting the portions of the conductor on said separate surfaces of different ones of said layers together to form said spirally disposed conductor.

26. A helical antenna as claimed in claim 20, wherein the dielectric substrate comprises a rectangular parallelopiped with said surface comprising six parallelopiped surfaces, said conductor being disposed on at least four surfaces of said rectangular parallelopiped.

27. A helical antenna as claimed in claim 20, wherein the conductor is formed by one of printing, deposition, pasting and plating.

28. A helical antenna as claimed in claim 16, wherein said conductor is provided in the dielectric substrate.

29. A helical antenna as claimed in claim 28, wherein said dielectric substrate comprises a plurality of layers of dielectric material.

30. A helical antenna as claimed in claim 29, wherein portions of the conductor are disposed on separate surfaces of respective ones of said layers of dielectric material joined together to form said dielectric substrate, with conductive through holes through the layers being provided connecting the portions of the conductor on said separate surfaces of different ones of said layers together to form said spirally disposed conductor.

31. A helical antenna as claimed in claim 28, wherein the conductor is formed by one of printing, deposition, pasting and plating.

32. A helical antenna as claimed in claim 28, wherein each turn of the conductor has a rectangular shape in transverse cross-section.

33. A helical antenna as claimed in claim 28, wherein each turn of the conductor has a track shape in transverse cross-section.

34. A helical antenna as claimed in claim 28, wherein each turn of the conductor has a semicircular shape in transverse cross-section.

35. A helical antenna as claimed in claim 28, wherein different turns of the conductor have a different shape in transverse cross-section.

36. A helical antenna as claimed in claim 16, wherein each turn of the conductor has a rectangular shape in transverse cross-section.

37. A helical antenna as claimed in claim 16, wherein each turn of the conductor has a track shape in transverse cross-section.

38. A helical antenna as claimed in claim 16, wherein each turn of the conductor has a semicircular shape in transverse cross-section.

39. A helical antenna as claimed in claim 16, wherein different turns of the conductor have a different shape in transverse cross-section.

40. A surface mounting antenna system, comprising:

a dielectric substrate having at least one flat surface to be mounted on a mounting board;

a conductor disposed spirally in the dielectric substrate; and a power supply terminal provided on a portion of the surface of said dielectric substrate for applying voltage to the conductor, the conductor having one end coupled to the power supply terminal and a second end left unconnected;

the dielectric substrate comprising a plurality of layers stacked on top of each other and defining a direction normal to the stacked layers;

the conductor disposed spirally in the dielectric substrate having a spiral axis extending perpendicular to the direction normal to the stacked layers.

41. A surface mounting type antenna system as claimed in claim 40, further comprising:

a mounting board; and a fixing terminal provided on a portion of the surface of said dielectric substrate for securing said dielectric substrate onto the surface of said mounting board.

42. A surface mounting antenna system as claimed in claim 4, wherein said conductor includes a portion disposed substantially perpendicularly with respect to the longitudinal axis and said portion partly includes at least one linear portion in transverse cross section through the conductor perpendicular to the longitudinal axis.

43. A surface mounting antenna system as claimed in claim 40, wherein said conductor includes a portion disposed substantially perpendicularly with respect to the longitudinal axis and said portion partly includes at least one linear portion in transverse cross section through the conductor perpendicular to the longitudinal axis.

44. A surface mounting antenna system as claimed in claim 40, wherein said dielectric substrate comprises a plurality of layers of dielectric material.

45. A surface mounting antenna system as claimed in claim 44, wherein portions of the conductor are disposed on separate surfaces of respective ones of said layers of dielectric material joined together to form said dielectric substrate, with conductive through holes through the layers being provided connecting the portions of the conductor on said separate surfaces of different ones of said layers together to form said spirally disposed conductor.

46. A surface mounting antenna system as claimed in claim 40, wherein the conductor is formed by one of printing, deposition, pasting and plating.

47. A surface mounting antenna system as claimed in claim 40, wherein each turn of the conductor has a rectangular shape in transverse cross-section.

48. A surface mounting antenna system as claimed in claim 40, wherein each turn of the conductor has a track shape in transverse cross-section.

49. A surface mounting antenna system as claimed in claim 40, wherein each turn of the conductor has a semicircular shape in transverse cross-section.

50. A surface mounting antenna system as claimed in claim 40, wherein different turns of the conductor have different shapes in transverse cross-section.

51. A helical antenna comprising:

a dielectric substrate having at least one flat surface to be mounted on a mounting board;

a conductor disposed spirally about a longitudinal axis of said dielectric substrate; and a power supply member provided at one end of said conductor, the other end of said conductor being a free end;

wherein the sensitivity of the antenna to dominant and cross polarized waves is provided in at least two dimensions, said two dimensions comprising a direction of a longitudinal axis and a direction perpendicular to the longitudinal axis;

the dielectric substrate comprising a plurality of layers stacked on top of each other, the layers being stacked so as to define a direction normal to the stacked layers;

the conductor disposed spirally about the longitudinal axis of the dielectric substrate such that the longitudinal axis is perpendicular to the direction normal to the stacked layers.

52. A surface mounting antenna system comprising:

a dielectric substrate having at least one flat surface to be mounted on a mounting board and having a longitudinal axis;

said dielectric substrate comprising a plurality of layers stacked on top of each other;

a conductor disposed spirally about the longitudinal axis about the stacked layers of the dielectric substrate; and a power supply terminal provided on a portion of the surface of said dielectric substrate for applying voltage to the conductor, the conductor having one end coupled to the power supply terminal and a second end left unconnected.

53. A helical antenna comprising:

a dielectric substrate having at least one flat surface to be mounted on a mounting board;

said dielectric substrate comprising a plurality of layers stacked on top of each other;

a conductor disposed spirally about and extending along a longitudinal axis of said dielectric substrate; and a power supply member provided at one end of said conductor, the other end of said conductor being a free end;

wherein the sensitivity of the antenna to dominant and cross polarized waves is provided in at least two dimensions, said two dimensions comprising a direction of the longitudinal axis and a direction perpendicular to the longitudinal axis.

54. A surface mounting antenna system, comprising:

a dielectric substrate having at least one flat surface to be mounted on a mounting board;

the dielectric substrate comprising a plurality of layers stacked on top of each other;

a conductor disposed spirally in the dielectric substrate; and a power supply terminal provided on a portion of the surface of said dielectric substrate for applying voltage to the conductor, the conductor having one end coupled to the power supply terminal and a second end left unconnected.

55. A helical antenna comprising:

a dielectric substrate having at least one flat surface to be mounted on a mounting board;

the dielectric substrate comprising a plurality of layers stacked on top of each other;

a conductor disposed spirally about a longitudinal axis of said dielectric substrate; and a power supply member provided at one end of said conductor, the other end of said conductor being a free end;

wherein the sensitivity of the antenna to dominant and cross polarized waves is provided in at least two dimensions, said two dimensions comprising a direction of a longitudinal axis and a direction perpendicular to the longitudinal axis.

* * * * *